United States Patent [19]

Knight

[11] 4,058,905

[45] Nov. 22, 1977

[54] METHOD FOR REDUCING RESIDENCE TIME AND ELIMINATING GAS LEAKAGE BETWEEN ZONES IN A CROSS-FLOW DEVICE FOR HEATING AND COOLING SOLIDS

[75] Inventor: John H. Knight, Aurora, Colo.

[73] Assignee: The Superior Oil Company, Houston, Tex.

[21] Appl. No.: 534,461

[22] Filed: Dec. 19, 1974

[51] Int. Cl.[2] ..... F26B 3/06

[52] U.S. Cl. ..... 34/15; 34/13; 34/216; 208/11 R; 432/18

[58] Field of Search ..... 165/104, 106; 432/14, 432/18; 34/13, 15, 20, 31, 33, 216, 217; 208/11 R, 11 LE

[56] References Cited

U.S. PATENT DOCUMENTS

| | | | |
|---|---|---|---|
| 948,751 | 2/1910 | Whitlatch | 34/31 |
| 2,031,049 | 2/1936 | Lee | 34/20 |
| 2,057,681 | 10/1936 | Harrington | 34/13 |
| 2,148,052 | 2/1939 | Ahlmann | 432/14 |
| 3,273,255 | 9/1966 | Kramer | 34/20 |
| 3,367,038 | 2/1968 | Bishop, Sr. | 34/31 |
| 3,402,479 | 9/1968 | Hohm et al. | 34/13 |
| 3,483,115 | 12/1969 | Haddad et al. | 208/11 |
| 3,671,027 | 6/1972 | Frans | 432/14 |
| 3,745,670 | 7/1973 | Hartwig | 34/217 |

*Primary Examiner*—John J. Camby
*Assistant Examiner*—Larry I. Schwartz
*Attorney, Agent, or Firm*—Arnold, White & Durkee

[57] ABSTRACT

A method for improved operation of a cross-flow device for heating and/or cooling a moving bed of solids by reducing residence time and eliminating gas leakage between adjacent heating and cooling zones. A bed of solid particles is formed on a grate for movement through heating and cooling zones or chambers. As the bed of particles is moved through the heating and cooling zones, cross flows of hot or cool gas are passed through the bed normal to the direction of bed movement. The use of downdraft gas flow in each zone of the cross-flow device permits the same pressure profile to be produced in each zone, and a zero pressure differential between zones from top to bottom of the bed. Thus active grate space between adjacent zones is reduced, and greater efficiency obtained. In addition, when heating of the solids is followed by cooling, the passage through the bed of the heating and cooling gas streams in the same direction permits heating of the lowermost particles in the bed after these particles have passed into the cooling zone of the device.

8 Claims, 2 Drawing Figures

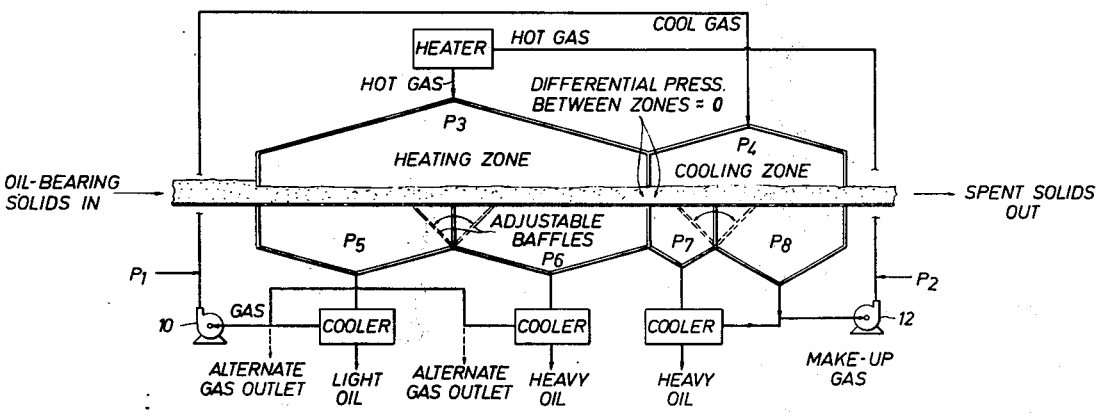

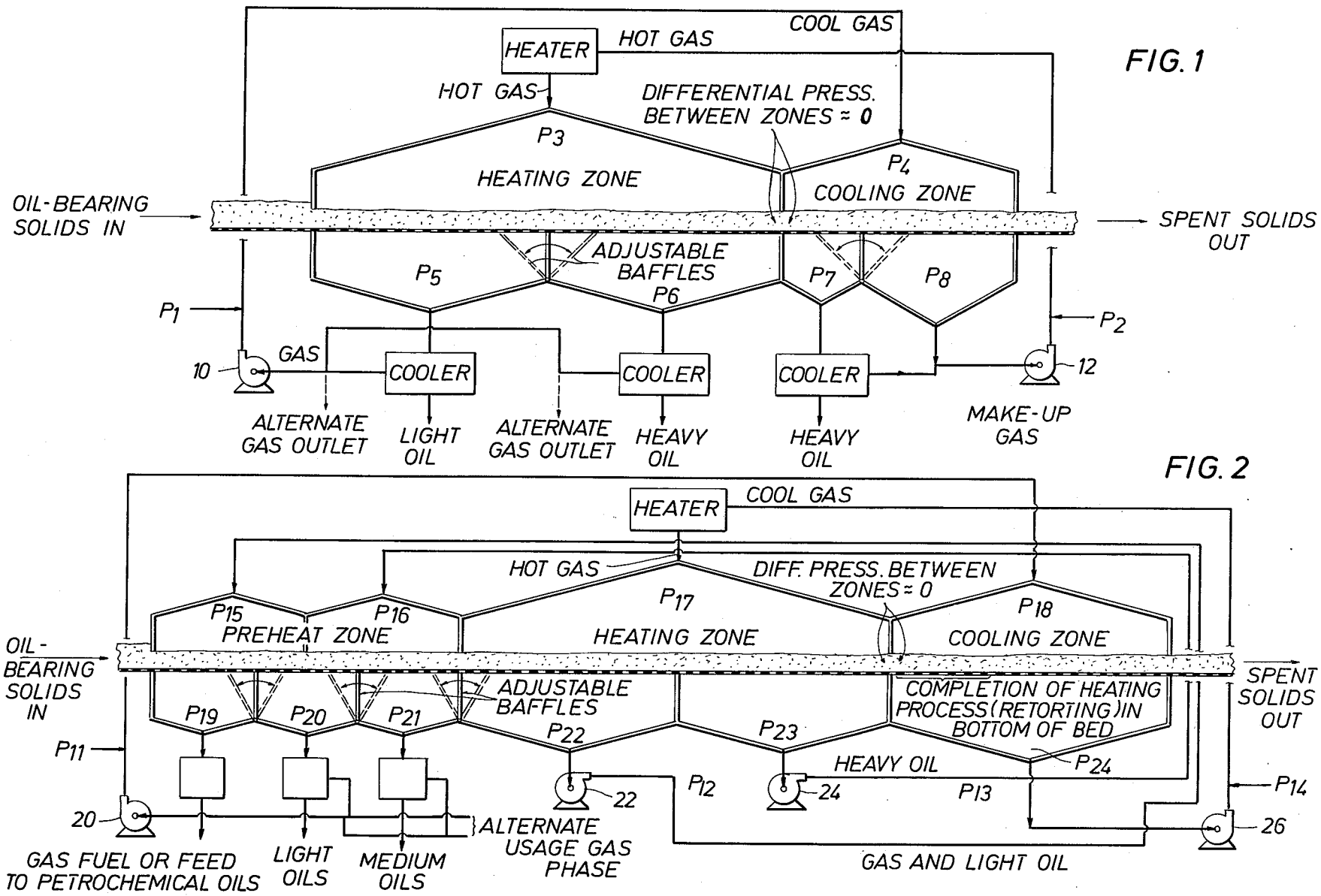
FIG. 1
SPENT SOLIDS OUT
P2
12
MAKE-UP GAS
COOL GAS
HOT GAS
DIFFERENTIAL PRESS. BETWEEN ZONES ≈ 0
P4
COOLING ZONE
P8
P7
COOLER
HEAVY OIL
HEATER
HOT GAS
P3
HEATING ZONE
ADJUSTABLE BAFFLES
P6
COOLER
HEAVY OIL
ALTERNATE GAS OUTLET
P5
COOLER
LIGHT OIL
ALTERNATE GAS OUTLET
GAS
10
P1
OIL-BEARING SOLIDS IN
FIG. 2
SPENT SOLIDS OUT
P14
26
COOL GAS
HEATER
DIFF. PRESS. BETWEEN ZONES ≈ 0
P18
COOLING ZONE
COMPLETION OF HEATING PROCESS (RETORTING) IN BOTTOM OF BED
P24
P13
HEAVY OIL
GAS AND LIGHT OIL
24
P23
P12
HOT GAS
P17
HEATING ZONE
ADJUSTABLE BAFFLES
P22
22
ALTERNATE USAGE GAS PHASE
P16
PREHEAT ZONE
P21
MEDIUM OILS
P20
LIGHT OILS
P15
P19
GAS FUEL OR FEED TO PETROCHEMICAL OILS
20
P11
OIL-BEARING SOLIDS IN

METHOD FOR REDUCING RESIDENCE TIME AND ELIMINATING GAS LEAKAGE BETWEEN ZONES IN A CROSS-FLOW DEVICE FOR HEATING AND COOLING SOLIDS

BACKGROUND OF THE INVENTION

The present invention relates to methods for increasing efficiency and throughput in cross-flow devices for heating and cooling solids, and, more particularly, to methods for reducing solids residence time and reducing gas leakage between adjacent heating and/or cooling zones in such devices.

Cross-flow devices for heating and cooling solids typically use a single forced draft or induced draft blower, or a combination of two or more blowers using forced draft and induced draft together, to produce a flow of heating or cooling gas through a gas permeable bed of solids. In a typical device such as, for example, a traveling grate of the type used in iron ore pelletizing, incoming cool solids are heated by a cross-flow of hot gas and then cooled by a cross flow of incoming cool gas to recover the sensible heating of the solids. For convenience, the terms "preheat zone" and "heating zone" will be used to refer to the portions of the device in which the solids are heated by cross flows of relatively hotter gas, and the term "cooling zone" will refer to the portions of the device in which the solids are similarly cooled. The off-gas from the cooling zone may be further heated to bring it to a desired temperature and then passed through the incoming bed of solids in the preheat or heating zone. In some applications, the off gas from the heating zone may be passed through the incoming solids bed prior to the heating zone to preheat the solids and to recover the available sensible heat from the gas.

To effect the flow of the gases from zone to zone, a variety of flow arrangements can and have been used. The blowers have heretofore usually been positioned away from hot gas areas, typically at the cooling zone gas inlet and/or the heating zone gas outlet. This method of moving the gases from zone to zone without intermediate blowers necessarily results in different pressure profiles within the zones, due to pressure drops in the ductwork as well as through the solids bed. The differential pressure between corresponding bed locations in the various zones causes air flow and leakage of gas between zones through the solids, along the path of the bed. This interzone gas leakage results in both energy lossess and product losses, reducing thermal efficiency of the apparatus and decreasing product yield.

The gas leakage between zones can be reduced by providing a space between zones along the path of travel of the solids. This crude seal works on the principle that for a given differential pressure the gas flow rate, in this case the interzone leakage, decreases as the length of the flow path increases. Thus, by increasing the distance between zones and sealing the void space above and below the bed, the leakage can be reduced. This type of seal, however, reduces the throughout capacity of the device because active traveling grate area must be used to provide the seal space between zones.

The heating or cooling of a bed of solids in a cross-flow device involves contact between the solids and the cross-flowing fluid for some finite period of time. "Residence time" is the time required for all the solids at a given point along the bed, (usually the discharge point or the point at which the bed leaves a heating or cooling chamber or zone of the device) to come to the desired temperature. The residence time necessary for any particular process depends, of course, on numerous heating and cooling variables. It will be appreciated that the solids closest to the gas discharge side of the bed will require the longest time to heat or cool. This is because the solids on the gas inlet side of the bed are the first to be exposed to the incoming gas, and the initial heat transfer between the incoming gas and these solids reduces the driving force for heat transfer to or from the solids as the gas flows to the gas outlet side of the bed. For example, the normal residence time in a heating zone is the sum of the time required for the incoming hot gas to reach the outlet side of the bed at the desired temperature plus the time required for heat transfer between that gas and the outlet side solids. As a consequence, the heating or cooling chamber or zone occupies a portion of the device where the solids near the gas inlet side of the bed are at the desired condition while those at the gas outlet side are still being heated or cooled.

SUMMARY OF THE INVENTION

In a cross-flow device for heating and cooling solids, such as a traveling grate retort, in which a bed of solid particles is moved horizontally through a plurality of zones for successively heating and cooling the solids, respective flows of gas are passed through the solids bed normal to the direction in which the bed is moving. By maintaining each of the gas flows through the bed at the same gas inlet and exit pressures, the tendency for gas to flow laterally between adjacent processing zones of the device is reduced or eliminated and the zones may be located immediately adjacent one another without interzone seals.

The total size of the apparatus required for performing successive heating and cooling operations in an all-downdraft traveling grate device can be reduced by passing the solids into the cooling zone after the top of the bed has reached the desired temperature, but before the solids at the bottom of the bed reach that temperature. The fully heated solids at the top of the bed then heat the downward flowing, incoming cool gas which, as it flows to the outlet side of the bed, then heats the lowermost solids to the desired temperature.

BRIEF DESCRIPTION OF THE DRAWING

A specific embodiment of the present invention will now be described with reference to the accompanying drawing, wherein:

FIG. 1 is a schematic sectioned elevation of a traveling grate oil shale retort suitable for carrying out various embodiments of the method of the present invention; and FIG. 2 is an alternative embodiment of the retort of FIG. 1, including a preheat zone immediately upstream of the heating zone.

DETAILED DESCRIPTION OF SPECIFIC EMBODIMENTS

Referring now to the drawing, illustrative embodiments of methods according to the present invention will be described with reference to schematic illustrations of apparatus suitable for use in accomplishing the various steps thereof. The features and advantages of the present invention will be fully appreciated by those familiar with commercially available apparatus which, therefore, will not be described in great detail. Such apparatus will be understood to include, for example, straight and circular traveling grates, such as those manufactured by Arthur G. McKee & Co. and McDowell-Wellman Engineering Co., both of Cleveland, Ohio. In such apparatus, a bed of solid particles is formed on a traveling grate which carries the bed horizontally through the device. Hoods and windboxes are disposed respectively above and below the traveling grate to define chambers or zones within which a fluid cross-flow is provided through the bed. The hoods and windboxes preferably are sealed to prevent entry of atmospheric air into, or loss of heat or material from, the chambers or zones.

The present invention is particularly advantageous in the retorting of oil shale wherein the oil shale is heated to recover hydrocarbon products and then the spent shale is cooled to recover some of its sensible heat. It will be appreciated that while the present invention will be described with reference to the retorting of oil shale, it may be practiced in connection with many other processes in which the heating and cooling of solid aggregates is desired. For this reason the embodiment described herein with respect to oil shale retorting is to be regarded as merely illustrative and not limiting of the scope of the present invention.

In accordance with one embodiment of the present invention, particles of mined, crushed oil shale ranging in size from about ¼ inch to 3 inches are deposited on a traveling grate to form a bed 4 to 5 feet deep. It will be understood that greater or lesser particle sizes and bed depths may be used in the method of this invention, such variations affecting the heating or cooling time necessary and the pressure drop of the heating or cooling fluid through the solids bed. A circular traveling grate such as that described in U.S. Pat. No. 3,302,936, which is incorporated herein by reference, may be used to transport the solids bed. The bed is continuously formed at the solids inlet to the apparatus and moved into and through a plurality of processing zones wherein respective cross-flows of hot and cool gas are provided to heat and cool the particles.

In the embodiment of FIG. 1, the solids bed is formed and moved successively through a heating zone and a cooling zone. The traveling grate moves continuously through the zones at a predetermined rate that, in combination with the length of the respective zones, determines the residence time for the solids in each of the zones. Blowers 10, 12 are provided to produce the desired crossflows of hot and cool gas through the bed. The gas pressures at the outlets of the blowers 10, 12 are designated by references $P_1$ and $P_2$, respectively. The gas pressures in the heating and cooling zone hoods above the traveling solids bed are designated by $P_3$ and $P_4$ respectively. The gas pressures in the various windboxes immediately below the traveling solids bed are designated by $P_5$, $P_6$, $P_7$, and $P_8$ as shown. In the present invention, the usual interzone seal that would normally be required along the grate path between the heating and cooling zones of the illustrated apparatus is no longer required. This is accomplished by maintaining the hood pressures $P_3$, $P_4$ just above the bed at values approximately equal to one another, and by maintaining the windbox pressures $P_5$, $P_6$, Phd 7, and $P_8$ just below the bed at values approximately equal to one another, so that the differential pressure along the path of the bed and between the respective zones is substantially zero. Of course, it will be appreciated that this condition need be maintained only at the interzone interface, and that variations may occur to a greater or lesser extent without significant degradation of the various processes to which this method is applied.

In the embodiment of FIG. 2, the bed is moved horizontally through the first chamber or zone designated the preheat zone. In this zone the mined oil shale solids are preheated in preparation for retorting. Preheating is accomplished by a downwardly directed flow of heated gas, which conventionally may be obtained from the gas outlet from the spent shale cooling zone. The outlet gas from the preheat zone may be reused or vented as desired. Blowers 20, 22, 24, and 26 supply the desired gas flows through the preheat, heating, and cooling zones. The hood, or inlet side, pressures $P_{15}$, $P_{16}$, $P_{17}$, and $P_{18}$ are maintained at values approximately equal to one another and the windbox, or outlet side, pressures $P_{19}$, $P_{20}$, $P_{21}$, $P_{22}$, $P_{23}$, and $P_{24}$ are maintained at values approximately equal to one another and lower than the hood pressures. In this manner, the differential pressures between the respective zones along the path of the bed is substantially zero and no significant interzone gas leakage occurs.

Movement of the grate carries the bed into a high temperature heating or retorting zone which is supplied with hot gas at a temperature of about 1,000°–1,500° F. In the embodiment of FIGS. 1 and 2, the gas is heated by an external heater. Of course, other means for heating the incoming retorting gas may be used. The hot retorting gas is directed downwardly through the bed, normal to the direction of movement of the bed. As the bed moves through the heating zone, the oil shale particles at the gas inlet side of the bed are contacted by the hot gas and heated. As these uppermost particles are heated, the gas is cooled, reducing the driving force for heat transfer to the lower particles. As the solids move through the heating zone, hotter particles are initially presented to the incoming hot gas and the heat of the gas therefore provides an increasing driving force to heat the lower particles in the bed.

In conventional oil shale retorting operations, the oil shale remains in the heating or retort zone of the apparatus until all of the solids have been brought to the desired retorting temperature, and maintained at that temperature for the desired retorting time. This controls the rate of bed movement through any given retort for a fixed hot gas inlet temperature. This minimum residence time of a particle in the bed is based on two important factors, the time required for the hot gas to reach the bottom of the bed plus the time required to heat the entire particle, from surface to center core, to the desired temperature for recovery of hydrocarbons. It will be understood that a greater heating time is required for larger particles and, since the upper layer of the bed is exposed to higher temperatures for longer times than the remainder of the bed, the segregation of particle sizes in the bed to place the smallest particles at the bottom and the largest at the top will improve the overall thermal efficiency of the operation. However, the difficulty and expense of so segregating the particle by size usually is not justified by the savings achieved.

At the initial stage of retorting, in the preheat or heating zone, the bed reaches a temperature sufficient for some light oil product to be educed from the oil shale solids. The higher temperature to which the bed is heated as the grate advances through the heating zone results in progressively heavier oil products being educed from the solids. A plurality of varying oil products may be collected in the manner illustrated as the bed passes through the respective preheat and/or heating zones. Product collection is into a corresponding plurality of containers, or divided collection means in the respective windboxes, from which the products are passed to respective cooler-condenser systems where the gas and oil products are separated and the liquids condensed.

In the embodiments of the present invention directed to the retorting of oil shale, the solids in the bed are moved from the heating zone into the cooling zone before the solids at the bottom of the bed have reached the desired retorting temperature. The hot, spent shale particles entering the cooling zone at the top of the bed provide sensible heat to the incoming cool gas. This sensible heat is transferred to the gas and carried down through the bed to bring the shale particles at the bottom of the bed to the desired temperature. Only after the upper shale particles have been cooled by the incoming gas will the lower particles be exposed to the cool gas, which will occur only after the particles have moved some distance into the cooling zone. Thus the final heating of the lower portion of the bed takes place at the same time and in the same location along the solids path as does the initial cooling of the upper portion of the bed. The heavy oil product from the shale in this area of the device is then collected in a manner similar to that described above for the product educed in the preheat and heating zones.

It will be appreciated from the foregoing that the methods of the present invention provide greatly improved efficiency and utilization of cross-flow devices for heating and cooling solids, particularly in reducing or eliminating interzone gas leakage and enabling much greater solids throughput per unit of grate area than has heretofore been possible. Accordingly, those skilled in the art will understand that numerous changes and modifications may be made in the illustrated embodiment of the inventive concept herein without departing from the scope and spirit thereof.

What is claimed is:

1. A method for improved operation of a cross-flow device for heat transfer between a moving bed of solid particles and a plurality of gas streams, comprising the steps of:

moving a gas-permeable bed of solid particles through adjacent first and second heat transfer zones wherein the particles are heated in one of the zones and cooled in the adjacent zone;

passing a first gas stream through the bed in the first zone, the gas being passed through the bed in a direction normal to the direction of movement of the bed to achieve a first heat transfer between the particles and the first gas stream;

passing a second gas stream through the bed in the second zone, the second gas stream being passed through the bed in the same direction as the first gas stream, and maintaining the first and second gas streams at the same inlet and outlet pressures respectively to reduce the lateral gas flow through the bed between the first and second heat transfer zones.

2. A method for improved operation of a cross-flow device for heat transfer between a moving bed of solid particles and a plurality of gas streams as recited in claim 1 wherein the bed of solid particles is moved horizontally through the heat transfer zones and the gas streams are passed vertically downward through the bed in the respective zones.

3. A method for improved operation of a cross-flow device for heat transfer between a moving bed of solid particles and a plurality of gas streams as recited in claim 2 wherein the bed of solid particles is supported on a traveling grate and moved with the grate through the successive heat transfer zones.

4. A method for improved operation of a cross-flow device for heat transfer between a moving bed of solid particles and a plurality of gas streams as recited in claim 3 wherein the first gas stream is of hot gas to heat the solid particles in the first heat transfer zone and the second gas stream is of cooler gas to cool the solid particles, and the heating of the particles near the bottom of the bed is completed in the second heat transfer zone by cooler gas that has been heated by the particles near the top of the bed as the particles move from the first into the second heat transfer zone.

5. A method for improved operation of a cross-flow device for heating and cooling a moving bed of solid particles with respective hot and cool gas streams, comprising the steps of:

forming a gas-permeable bed of solid particles on a traveling grate;

moving the bed of particles horizontally through successive heating and cooling zones of a device for passing cross-flows of gas through the bed, each of the zones having a solids entry and a solids exit;

passing a first gas stream of hot gas through the bed in the heating zone to heat the particles moving through the heating zone, said first gas stream being in a first direction perpendicular to the movement of the bed;

passing a second gas stream of cool gas through the bed in the cooling zone to cool the heated particles moving through the cooling zone, the hot particles at the gas inlet side of the bed near the solids entry of the cooling zone heating the cool gas entering the bed, the cool gas so heated then heating the particles more remote from the gas inlet side of the bed near the solids entrance to the cooling zone, said second gas stream being in the same direction as said first gas stream, and maintaining the respective streams of hot and cool gas at substantially equal inlet and outlet pressures respectively to reduce the lateral flow of gas through the bed between the heating and cooling zones of the device.

6. In a process employing a traveling grate retort wherein a bed of particulate material is passed through adjacent first and second zones for successively heating and cooling the particulate material, and wherein independent gaseous streams are directed in cross-flow fashion with respect to the bed in each of the first and second zones, the improvement comprising maintaining the pressure profile through the bed at the interface between the two adjacent zones substantially the same in the first zone as in the second zone so as to minimize lateral along-the bed gas flow through the particulate material between the adjacent zones.

7. In a process for retorting oil shale particles in a moving bed wherein the particles are heated to educe oil products and then cooled to recover sensible heat, the heating and cooling being accomplished with streams of hot gas and cool gas respectively, the method for improving the thermal efficiency of the process which comprises the steps the thermal efficiency of the process which comprises the steps of moving the bed of oil shale particles through adjacent first and second heat transfer zones; passing a stream of hot gas through the bed in the first zone, the hot gas being passed through the bed in a direction normal to the direction of movement of the bed to heat the particles for eduction of oil products therefrom; passing a stream of cool gas through the bed in the second zone, the cool gas being passed through the bed in the same direction as the hot gas to recover sensible heat from the heated particles; and maintaining the hot and cool gas streams at substantially the same gas inlet and gas outlet pressures respectively to reduce the flow of gas through the bed parallel to the direction of movement of the bed between the first and second heat transfer zones.

8. In a process for retorting oil shale particles in a horizontally moving gas-permeable bed wherein the particles are heated to educe oil products and then cooled to recover sensible heat, the heating and cooling being accomplished with streams of hot gas and cool gas respectively, the method for improving the thermal efficiency of the process which comprises the steps of moving the bed of oil shale particles through adjacent heating and cooling zones; passing a stream of hot gas downwardly through the bed in the heating zone to heat the particles for eduction of oil products therefrom; passing a stream of cool gas downwardly through the bed in the cooling zone to recover sensible heat from the heated particles; and maintaining the pressure of the hot and cool gas streams substantially the same as one another at the top of the bed and substantially the same as one another at the bottom of the bed to reduce the lateral flow of gas through the bed between the heating and cooling zones.

* * * * *

UNITED STATES PATENT AND TRADEMARK OFFICE

CERTIFICATE OF CORRECTION

PATENT NO. : 4,058,905

DATED : November 22, 1977

INVENTOR(S) : John H. Knight

It is certified that error appears in the above-identified patent and that said Letters Patent are hereby corrected as shown below:

Column 1, Line 60, change "throughout" to -- throughput --.

Column 1, Line 68, delete comma between "bed" and "(usually".

Column 7, Line 1, delete "the thermal efficiency of the".

Column 7, Line 2, delete "process which comprises the steps".

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*